US010520850B2

(12) United States Patent
Nishina et al.

(10) Patent No.: US 10,520,850 B2
(45) Date of Patent: Dec. 31, 2019

(54) IMAGE FORMING APPARATUS AND IMAGE FORMING METHOD

(71) Applicant: Ricoh Company, Ltd., Ohta-ku, Tokyo (JP)

(72) Inventors: Hiroaki Nishina, Tokyo (JP); Koichi Murota, Tokyo (JP); Yoshinobu Sakaue, Kanagawa (JP); Masashi Suzuki, Saitama (JP); Susumu Narita, Tokyo (JP); Takuma Nishio, Kanagawa (JP); Ryo Sato, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 16/267,453

(22) Filed: Feb. 5, 2019

(65) Prior Publication Data

US 2019/0286005 A1 Sep. 19, 2019

(30) Foreign Application Priority Data

Mar. 15, 2018 (JP) ..... 2018-048240

(51) Int. Cl.

*G03G 15/04* (2006.01)
*G03G 15/043* (2006.01)
*G03G 15/00* (2006.01)

(52) U.S. Cl.

CPC ..... *G03G 15/043* (2013.01); *G03G 15/04054* (2013.01); *G03G 15/5025* (2013.01); *G03G 2215/00067* (2013.01); *G03G 2215/0409* (2013.01)

(58) Field of Classification Search

CPC ..... G03G 15/043; G03G 15/04054; G03G 15/5025; G03G 15/5062; G03G 2215/00067; G03G 2215/0409

See application file for complete search history.

(56) References Cited

U.S. PATENT DOCUMENTS

2005/0174418 A1 8/2005 Sakaue et al.
2007/0153079 A1 7/2007 Sakaue et al.
2009/0231606 A1 9/2009 Kawai et al.

(Continued)

FOREIGN PATENT DOCUMENTS

JP 2003-291409 10/2003
JP 2007-118194 5/2007
JP 2012-237900 12/2012

*Primary Examiner* — Sophia S Chen

(74) *Attorney, Agent, or Firm* — Harness, Dickey & Pierce, P.L.C.

(57) ABSTRACT

An image forming apparatus includes circuitry, a reader, and an exposure device that drives lighting elements aligned in a main scanning direction to form a first test image. The circuitry acquires density of first sub-areas, into which the first test image is divided in the main scanning direction, and calculates first correction data based on density of each of the first sub-areas and average density of the first sub-areas, to correct light amounts of the lighting elements. The exposure device forms a second test image with the light amounts corrected. The circuitry acquires density of second sub-areas, into which the second test image is divided in the main scanning direction, and calculates second correction data based on density of a second sub-area adjacent to each of the second sub-areas, to further correct the light amounts. The second sub-areas are differently located from the first sub-areas in the main scanning direction.

8 Claims, 9 Drawing Sheets

(56) References Cited

U.S. PATENT DOCUMENTS

| | | | | |
|---|---|---|---|---|
| 2010/0253981 | A1 | 10/2010 | Higashiyama et al. | |
| 2012/0288291 | A1 | 11/2012 | Miyadera | |
| 2013/0278703 | A1* | 10/2013 | Hirano | G03G 15/043 347/224 |
| 2014/0240800 | A1* | 8/2014 | Murayama | H04N 1/028 358/496 |
| 2016/0275381 | A1 | 9/2016 | Maeda et al. | |
| 2018/0239271 | A1 | 8/2018 | Suzuki | |
| 2018/0356759 | A1 | 12/2018 | Narita et al. | |

* cited by examiner

IMAGE FORMING APPARATUS AND IMAGE FORMING METHOD

CROSS-REFERENCE TO RELATED APPLICATIONS

This patent application is based on and claims priority pursuant to 35 U.S.C. § 119(a) to Japanese Patent Application No. 2018-048240, filed on Mar. 15, 2018, in the Japan Patent Office, the entire disclosure of which is hereby incorporated by reference herein.

BACKGROUND

Technical Field

Embodiments of the present disclosure relate to an image forming apparatus and an image forming method.

Related Art

Various types of electrophotographic image forming apparatuses are known, including copiers, printers, facsimile machines, and multifunction machines having two or more of copying, printing, scanning, facsimile, plotter, and other capabilities. Such image forming apparatuses usually form an image on a recording medium according to image data. Specifically, in such image forming apparatuses, for example, a charger uniformly charges a surface of a photoconductor as an image bearer. An optical writer irradiates the surface of the photoconductor thus charged with a light beam to form an electrostatic latent image on the surface of the photoconductor according to the image data. A developing device supplies toner to the electrostatic latent image thus formed to render the electrostatic latent image visible as a toner image. The toner image is then transferred onto a recording medium either directly, or indirectly via an intermediate transfer belt. Finally, a fixing device applies heat and pressure to the recording medium bearing the toner image to fix the toner image onto the recording medium. Thus, an image is formed on the recording medium.

In such electrophotographic image forming apparatuses, the image density might become uneven in a main scanning direction, due to variations in light amount of a light source in the main scanning direction. In order to reduce or correct the density unevenness in the main scanning direction, for example, the light amount of the light source is adjusted based on density unevenness detected in the main scanning direction from density data acquired from a test pattern image.

SUMMARY

In one embodiment of the present disclosure, a novel image forming apparatus includes an exposure device, a reader, and circuitry. The exposure device includes a plurality of lighting elements aligned in a main scanning direction. The exposure device is configured to drive the plurality of lighting elements to form a first test image. The reader is configured to read the first test image. The circuitry is configured to: divide the first test image into a plurality of first sub-areas in the main scanning direction to acquire density data of the plurality of first sub-areas; and calculate first correction data based on density data of each of the plurality of first sub-areas and average density data of the plurality of first sub-areas, to correct a light amount of the plurality of lighting elements based on the first correction data calculated. The first correction data is density correction data for each of the plurality of first sub-areas. The exposure device is configured to form a second test image with the light amount of the plurality of lighting elements corrected. The reader is configured to read the second test image. The circuitry is configured to divide the second test image into a plurality of second sub-areas in the main scanning direction to acquire density data of the plurality of second sub-areas. The plurality of second sub-areas has a different location from a location of the plurality of first sub-areas in the main scanning direction. The circuitry is configured to calculate second correction data based on density data of a second sub-area adjacent to each of the plurality of second sub-areas, to further correct the light amount of the plurality of lighting elements based on the second correction data calculated. The second correction data is density correction data for each of the plurality of second sub-areas.

Also described is a novel image forming method.

BRIEF DESCRIPTION OF THE DRAWINGS

A more complete appreciation of the embodiments and many of the attendant advantages and features thereof can be readily obtained and understood from the following detailed description with reference to the accompanying drawings, wherein.

The accompanying drawings are intended to depict embodiments of the present disclosure and should not be interpreted to limit the scope thereof. Also, identical or similar reference numerals designate identical or similar components throughout the several views.

DETAILED DESCRIPTION

Figure 1:
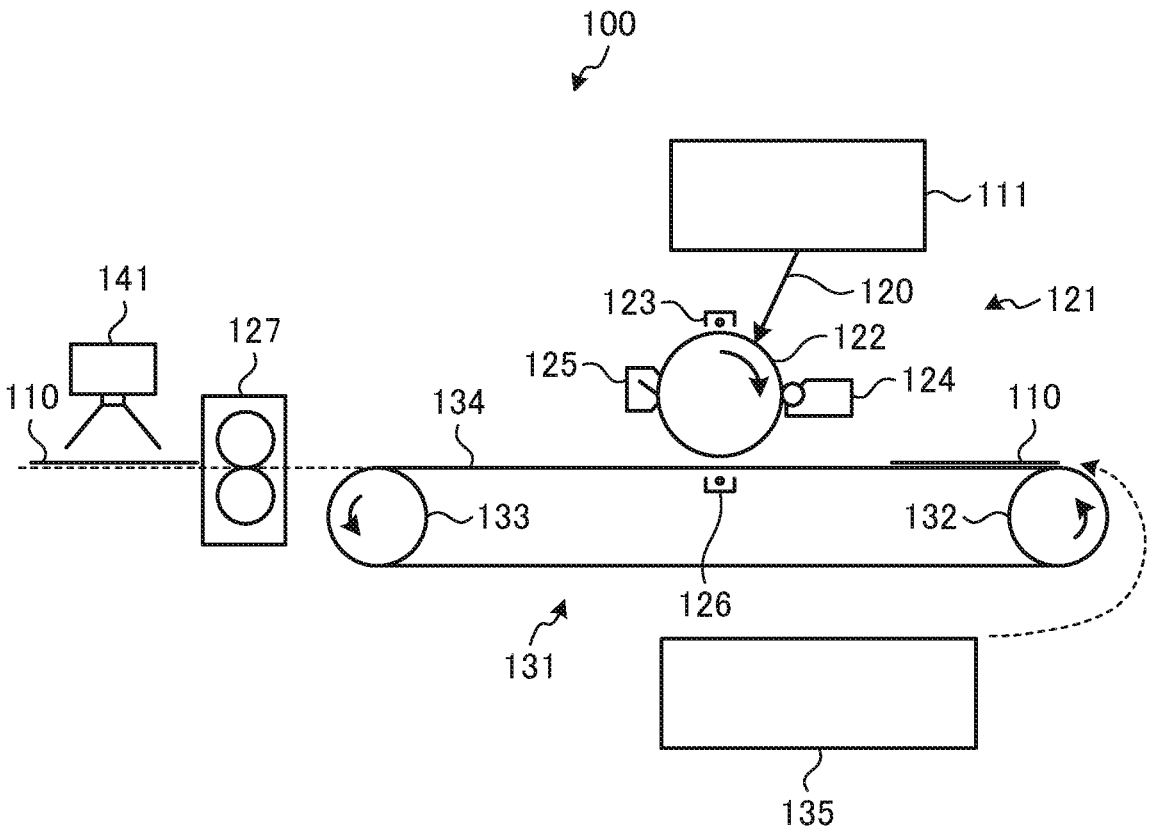
FIG. 1 is a schematic view of an image forming apparatus according to an embodiment of the present disclosure.

In describing embodiments illustrated in the drawings, specific terminology is employed for the sake of clarity. However, the disclosure of the present specification is not intended to be limited to the specific terminology so selected and it is to be understood that each specific element includes all technical equivalents that have a similar function, operate in a similar manner, and achieve a similar result.

Although the embodiments are described with technical limitations with reference to the attached drawings, such description is not intended to limit the scope of the disclosure and not all of the components or elements described in the embodiments of the present disclosure are indispensable to the present disclosure.

In a later-described comparative example, embodiment, and exemplary variation, for the sake of simplicity like reference numerals are given to identical or corresponding constituent elements such as parts and materials having the same functions, and redundant descriptions thereof are omitted unless otherwise required.

As used herein, the singular forms "a", "an", and "the" are intended to include the plural forms as well, unless the context clearly indicates otherwise.

Referring to the drawings, wherein like reference numerals designate identical or corresponding parts throughout the several views, embodiments of the present disclosure are described below.

Figure 2:
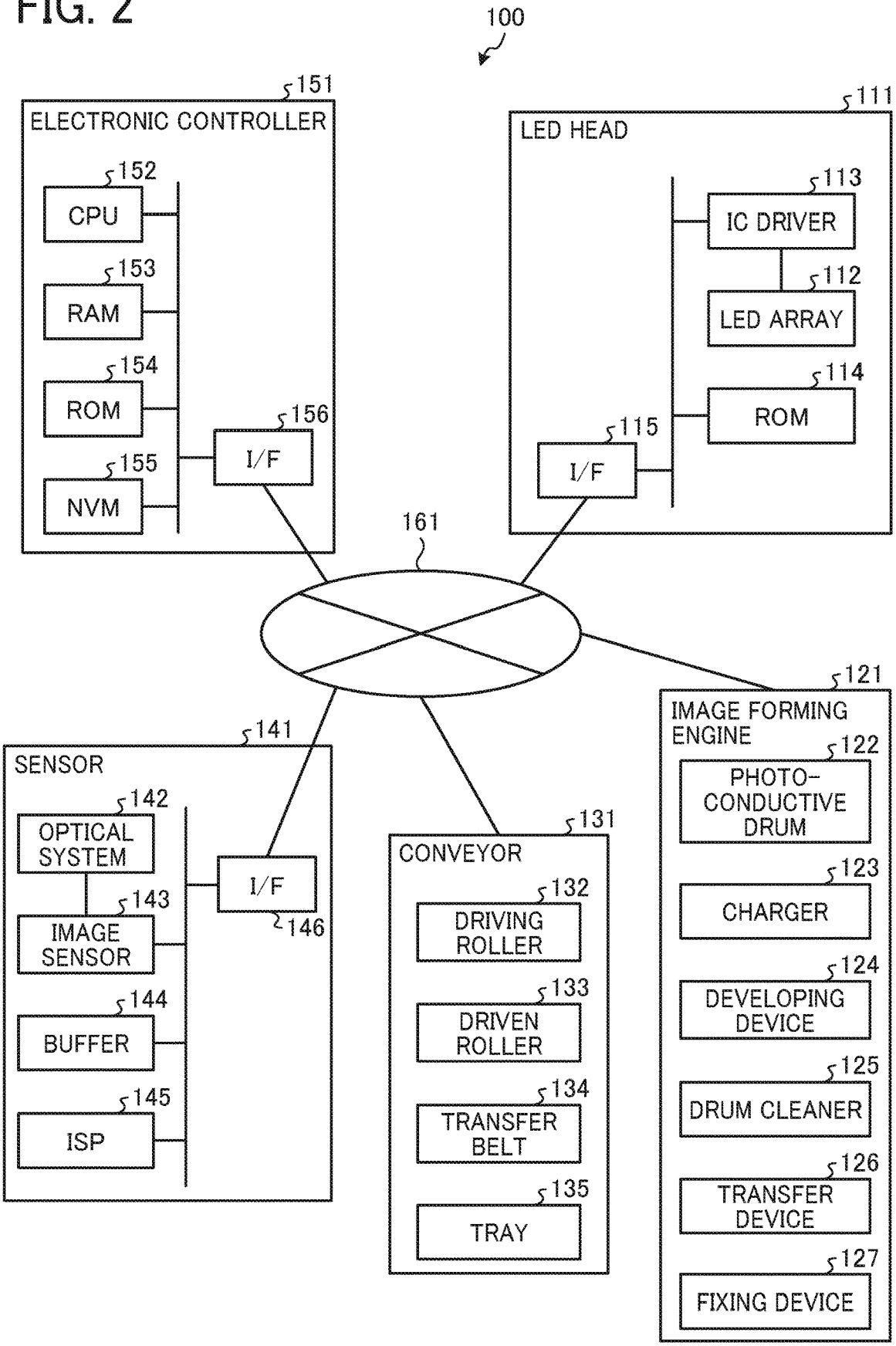
FIG. 2 is a block diagram illustrating a hardware configuration of the image forming apparatus.

Initially with reference to FIGS. 1 and 2, a description is given of a hardware configuration of an image forming apparatus according to an embodiment of the present disclosure.

FIG. 1 is a schematic view of an image forming apparatus 100 according to an embodiment of the present disclosure. FIG. 2 is a block diagram illustrating a hardware configuration of the image forming apparatus 100.

The image forming apparatus 100 includes a light emitting diode (LED) head 111, an image forming engine 121, a conveyor 131, a sensor 141, an electronic controller 151, and a network 161. The image forming apparatus 100 employs a system to form a desired image on a medium 110 by use of light 120 that is output from the LED head 111. The image forming apparatus 100 may be, e.g., a printer, a copier, a facsimile machine, or a multifunction peripheral (MFP) having at least two of printing, copying, scanning, facsimile, and plotter functions.

The LED head 111 is a device that outputs the light 120. As illustrated in FIG. 2, the LED head 111 includes an LED array 112, an integrated circuit (IC) driver 113, a read only memory (ROM) 114, and an interface (I/F) 115.

The LED array 112 is a device constructed of a plurality of LEDs, as lighting elements, arrayed. The IC driver 113 is a semiconductor device that controls a light amount of the LED array 112. The IC driver 113 may control the light amount of the LED array 112 so as to individually change the amount of light that is emitted by the plurality of LEDs. The IC driver 113 is driven according to a control signal from the electronic controller 151. For example, the IC driver 113 is configured to change a drive current supplied to the LED array 112 according to the control signal. The ROM 114 is a nonvolatile memory that stores various types of data related to the output of the light 120. The I/F 115 is a device that sends and receives signals to and from other devices (e.g., electronic controller 151) via the network 161.

According to the present embodiment, the ROM 114 stores data indicating a correction value corresponding to a characteristic of the LED head 111. A detailed description of the correction value is deferred.

As illustrated in FIGS. 1 and 2, the image forming engine 121 includes a photoconductive drum 122 serving as a photoconductor, a charger 123, a developing device 124, a drum cleaner 125, a transfer device 126, and a fixing device 127. The conveyor 131 includes a driving roller 132, a driven roller 133, a transfer belt 134, and a tray 135.

The photoconductive drum 122 is a cylinder that bears a latent image and a toner image. The charger 123 uniformly charges the surface of the photoconductive drum 122. The LED head 111 irradiates, with the light 120, the surface of the photoconductive drum 122 thus charged, such that the light 120 output from the LED head 111 draws a given trajectory on the surface of the photoconductive drum 122 according to given image data. Thus, an electrostatic latent image is formed in a given shape on the surface of the photoconductive drum 122. The developing device 124 causes toner to adhere to the electrostatic latent image, rendering the electrostatic latent image visible as a toner image on the surface of the photoconductive drum 122. Thus, the toner image is formed on the surface of the photoconductive drum 122. The electronic controller 151 outputs control signals to control operations of the photoconductive drum 122, the charger 123, and the developing device 124.

The transfer device 126 transfers the toner image from the surface of the photoconductive drum 122 onto the medium 110. In the conveyor 131, the tray 135 houses the medium 110 therein. The tray 135 is provided with a device that sends out the medium 110 onto the transfer belt 134. Thus, the tray 135 serves as a sheet feeder with the device. The transfer belt 134 is entrained around the driving roller 132 and the driven roller 133. The driving roller 132 drives and rotates the transfer belt 134 such that the transfer belt 134 conveys the medium 110. The electronic controller 151 outputs control signals to control operations of the transfer device 126, the driving roller 132, and the tray 135, so as to transfer the toner image from the surface of the photoconductive drum 122 onto the medium 110.

In the image forming engine 121, the drum cleaner 125 removes residual toner from the surface of the photoconductive drum 122 after the toner image is transferred onto the medium 110. In this case, the residual toner is toner that has failed to be transferred onto the medium 110 and therefore remains on the surface of the photoconductive drum 122. The medium 110 bearing the toner image is conveyed to the fixing device 127. The fixing device 127 fixes the toner image onto the medium 110 under heat and pressure. Thus, an image is formed on the medium 110. The electronic controller 151 outputs control signals to control operations of the drum cleaner 125 and the fixing device 127.

The sensor 141 is a device that acquires data for generating density information on the density of the image formed on the medium 110. As illustrated in FIG. 2, the sensor 141 includes an optical system 142, an image sensor 143, a buffer 144, an image signal processor (ISP) 145, and an I/F 146.

The image sensor 143 acquires an optical signal of the image on the medium 110 via the optical system 142 such as a lens, to photoelectrically convert the optical signal into an electric signal. Thus, the image sensor 143 generates an electric signal. Examples of the image sensor 143 include a complementary metal-oxide-semiconductor (CMOS) sensor and a charge coupled device (CCD) sensor. The ISP 145 is a device that performs given image processing, such as noise removal, on the electric signal generated by the image sensor 143. The ISP 145 may be a logic circuit that performs relatively simple processing such as noise removal. Alternatively, the ISP 145 may be a circuit that performs relatively advanced information processing (e.g., calculation of image density), with a processor that performs arithmetic processing according to a given program. After processing data, the ISP 145 transmits the processed data to the electronic controller 151 via the I/F 146 and the network 161. The buffer 144 is, e.g., a semiconductor memory that temporarily stores the electric signal generated by the image sensor 143, the data processed by the ISP 145, and the like.

The electronic controller 151 is a device that controls the entire image forming apparatus 100. The electronic controller 151 includes a central processing unit (CPU) 152, a random access memory (RAM) 153, a ROM 154, a nonvolatile memory (NVM) 155, and an I/F 156.

The ROM 154 stores programs for controlling the image forming apparatus 100. The CPU 152 performs various types of arithmetic processing to control the image forming apparatus 100 according to the programs stored in the ROM 154. The RAM 153 is a memory that functions mainly as a work area of the CPU 152. The NVM 155 is a nonvolatile memory that stores various types of data for controlling the image forming apparatus 100. The I/F 156 is a device that sends and receives signals to and from other devices, namely, the LED head 111, the image forming engine 121, the conveyor 131, and the sensor 141, via the network 161.

Figure 3:
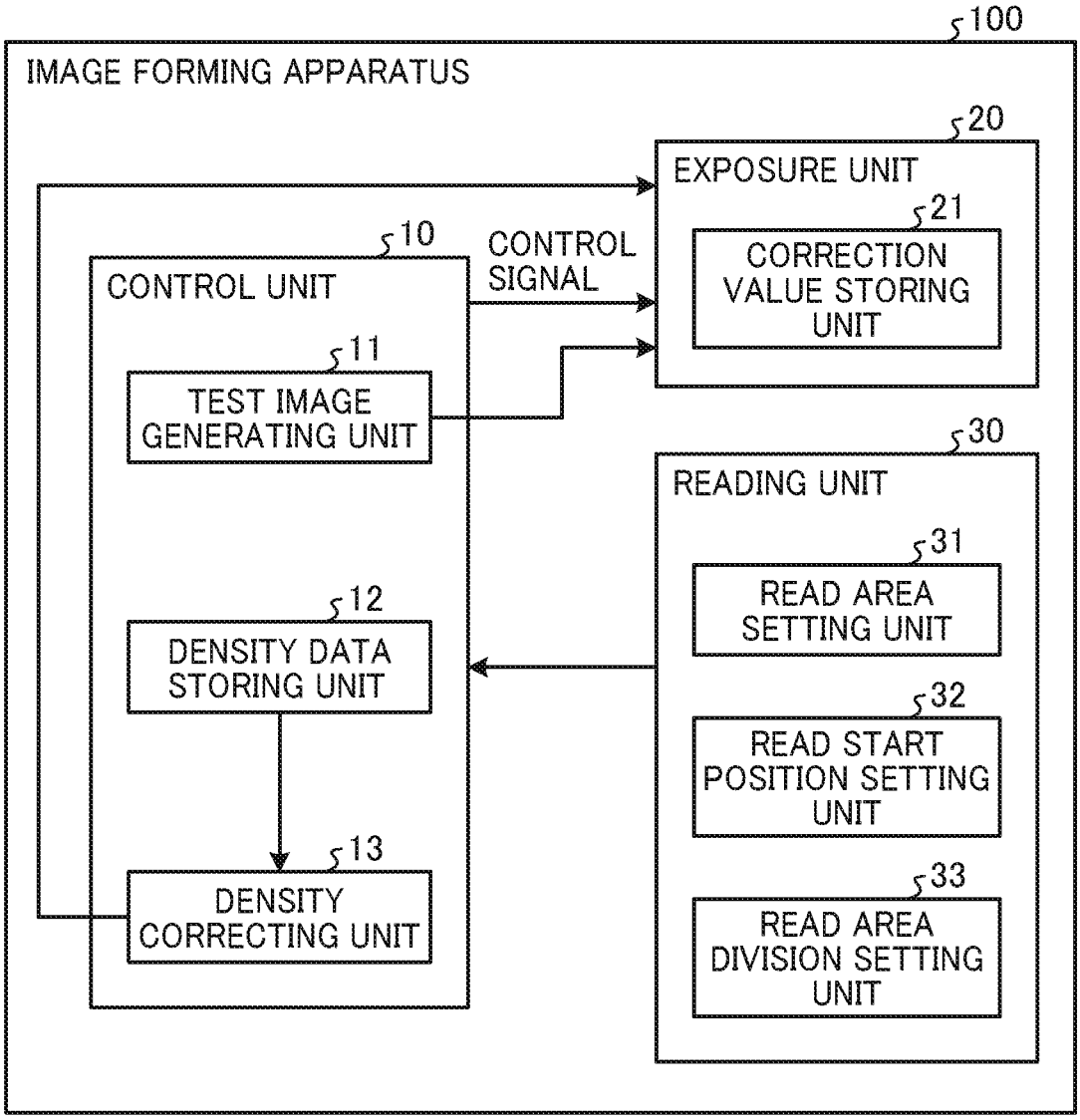
FIG. 3 is a block diagram illustrating a functional configuration of the image forming apparatus.

Referring now to FIG. 3, a description is given of a functional configuration of the image forming apparatus 100 described above.

FIG. 3 is a block diagram illustrating a functional configuration of the image forming apparatus 100.

The image forming apparatus 100 includes a control unit 10, an exposure unit 20, and a reading unit 30.

The control unit 10 is a functional unit that performs various types of processing to control the image forming apparatus 100. The control unit 10 is implemented by, e.g., the electronic controller 151. The control unit 10 includes a test image generating unit 11, a density data storing unit 12, and a density correcting unit 13. The control unit 10 generates a control signal to control the exposure unit 20. On the other hand, the control unit 10 generates a control signal to control the image forming engine 121 and the conveyor 131 illustrated in FIG. 2.

The exposure unit 20 is a functional unit that outputs the light 120. The exposure unit 20 is implemented by an exposure device such as the LED head 111. According to a control signal from the control unit 10, the exposure unit 20 changes an amount of the light 120 to output.

The exposure unit 20 includes a correction value storing unit 21. The correction value storing unit 21 is implemented by, e.g., the ROM 114 of the LED head 111. In a case in which the LED head 111 does not include the ROM 114, the correction value storing unit 21 may be implemented by the ROM 154 that stores programs. The correction value storing unit 21 stores correction data of each LED of the LED head 111. The correction data of each LED includes light amount correction data c and density correction data ρ.

Variations in light amount of the plurality of LEDs of the LED head 111 also cause variations in density of an image formed. To address such a situation, the light amount of each LED is corrected when the image forming apparatus 100 is manufactured, for example. Specifically, for example, the LEDs are sequentially driven, then the light amount of each LED is detected. Parameters such as a driving current and a driving time for driving each LED are adjusted to set each light amount at a given value. The light amount correction data includes driving parameters such as the driving current and the driving time. Calculated light amount correction data c is stored in the correction value storing unit 21. When the LED head 111 is driven, for example, the driving current is adjusted based on each light amount correction data c stored in the correction value storing unit 21, thereby correcting the light amount of each LED and reducing the variations in image density.

On the other hand, in the LED head 111, variations in shape and characteristics of each LED, variations in arrangement of the LEDs, or variations in optical characteristics of a lens array might cause vertical stripes extending in a sub-scanning direction of an image. Such vertical stripes appearing on an image degrades the image quality.

To address such a situation, the correction value storing unit 21 stores the density correction data ρ of each LED. The density correction data ρ is created at the time of manufacturing, inspection or normal use of the image forming apparatus 100. A detailed description of a procedure of creating the density correction data ρ is deferred.

The reading unit 30 reads an image formed on the medium 110 and acquires density data of the image. In addition, the reading unit 30 reads a test image formed on the medium 110 and acquires density data of the test image. The reading unit 30 is implemented by, e.g., the sensor 141 serving as a reader and the electronic controller 151. The reading unit 30 includes a read area setting unit 31, a read start position setting unit 32, and a read area division setting unit 33.

The read area setting unit 31 sets a resolution in a main scanning direction for reading the test image formed on the medium 110. The read area setting unit 31 sets a size of a sub-area, which is one of sub-areas into which the test image is divided in the main scanning direction. The sub-areas include at least two sub-areas serving as a first sub-area and a second sub-area. The read start position setting unit 32 sets a main-scanning position Xs and a sub-scanning position Ys as positions to start reading the test image. The read area division setting unit 33 sets the number of sub-areas.

The test image generating unit 11 generates a test image TP for inspecting the image density.

Figure 4:
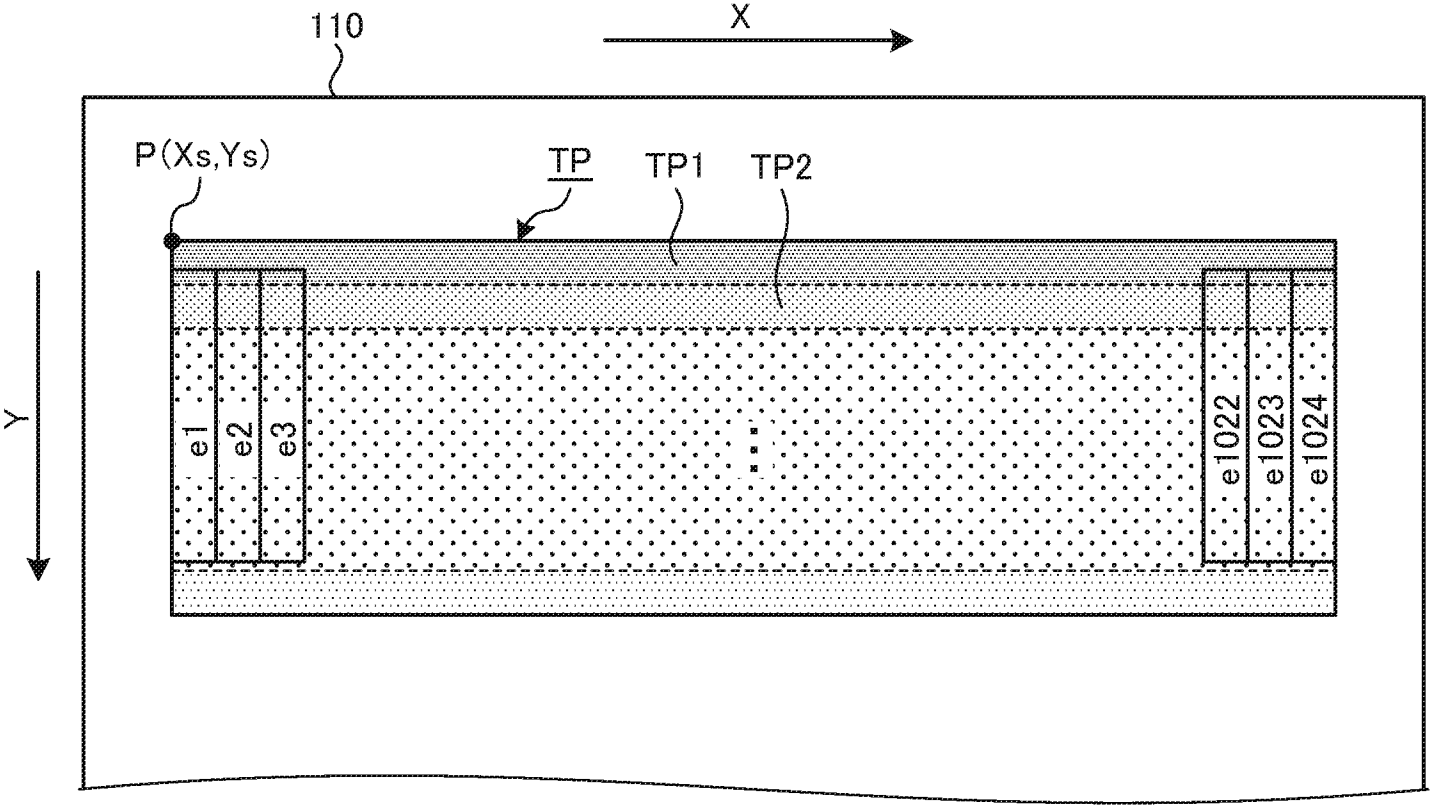
FIG. 4 is a plan view of a test image formed on a medium, illustrating an example of area division.

FIG. 4 is a plan view of an example of the test image TP formed on the medium 110, illustrating an example of a plurality of sub-areas e1 to e1024 aligned in the main scanning direction.

The test image TP includes a plurality of image patterns, such as image patterns TP1 and TP2, each having an even density along a main scanning direction X and a given width along a sub-scanning direction Y. Although each of the plurality of image patterns has an even density, individual image patterns are different from each other in density. For example, the image density of the image pattern TP1 is different from the image density of the image pattern TP2.

Area setting illustrated in FIG. 4 excludes right and left ends of a white background of the medium 110. That is, the plurality of sub-areas e1 to e1024 is set in a portion where the test image TP is actually printed. FIG. 4 illustrates an example of a read start position P (Xs, Ys) set by the read start position setting unit 32. In the example illustrated in FIG. 4, 1024 is the number of sub-areas set by the read area division setting unit 33.

The density data storing unit 12 stores density data of the test image TP read by the reading unit 30. The density data storing unit 12 is implemented by, e.g., the buffer 144 of the sensor 141, the RAM 153 and the NVM 155 of the electronic controller 151.

The density correcting unit 13 is implemented by, e.g., the electronic controller 151. The density correcting unit 13 calculates the density correction data ρ of each LED of the exposure unit 20 based on the density data stored in the density data storing unit 12.

Note that some or all of the functions described above with reference to FIG. 3 may be configured by software or hardware.

Figure 5:
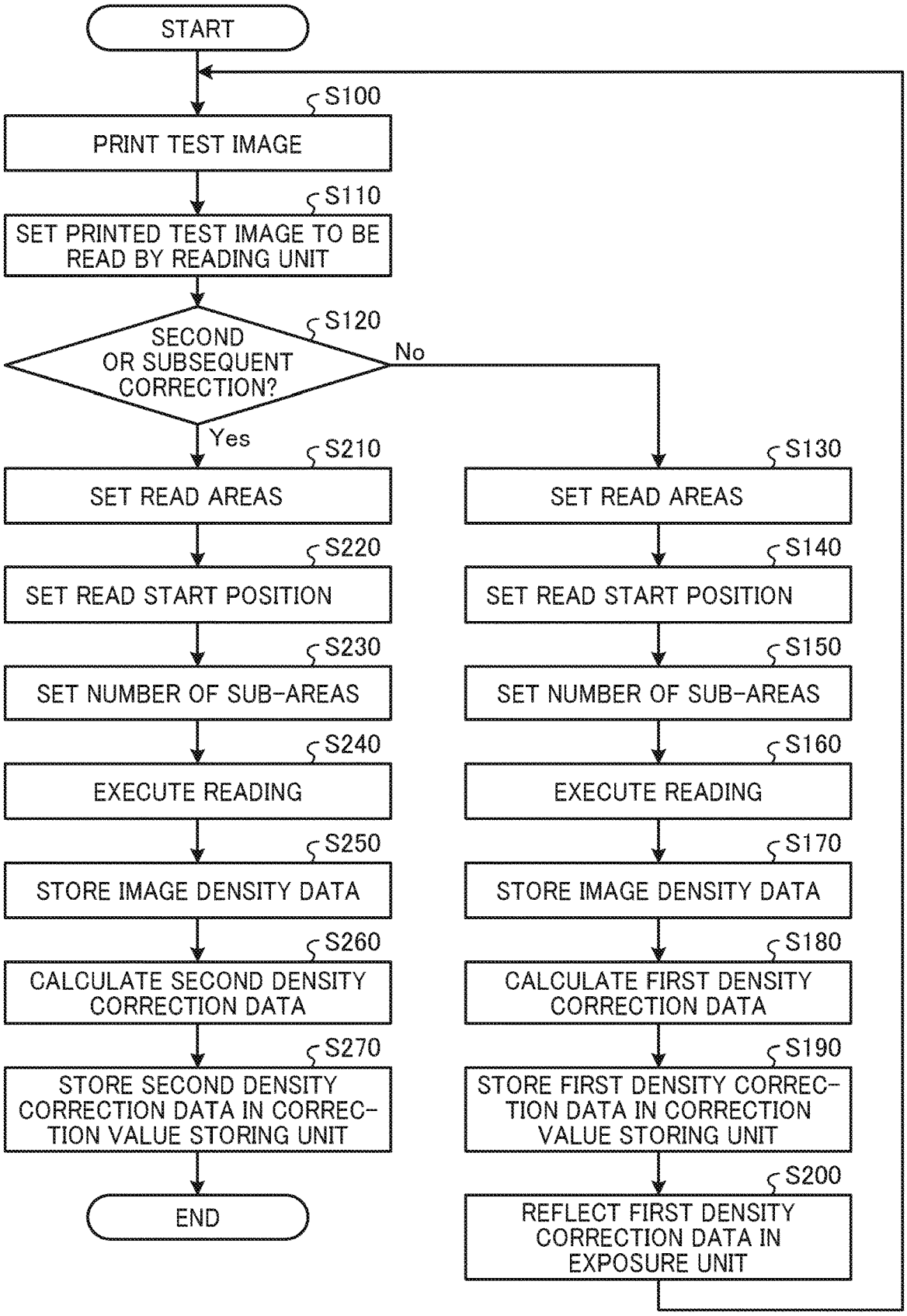
FIG. 5 is a flowchart illustrating a density correcting procedure performed by the image forming apparatus.

Referring now to FIG. 5, a description is given of a procedure of calculating the density correction data ρ.

FIG. 5 is a flowchart illustrating a density correcting procedure performed by the image forming apparatus 100.

Initially, in step S100, the test image generating unit 11 outputs a test image. Thus, the test image is printed on the medium 110.

In step S110, the test image thus printed (i.e., printed test image) is set to be read by the reading unit 30.

In step S120, the reading unit 30 determines whether the current correcting operation is a first correction or a subsequent correction (i.e., second or later correction).

When the reading unit 30 determines that the current correcting operation is the first correction (NO in step S120), the reading unit 30 sets read areas (i.e., sub-areas), a read start position, and the number of sub-areas for the first correction in steps S130, S140, and S150, respectively.

In step S160, the reading unit 30 executes reading of the test image based on the read areas, the read start position, and the number of sub-areas thus set.

In step S170, the density data storing unit 12 stores density data of the test image read by the reading unit 30.

Figure 6:
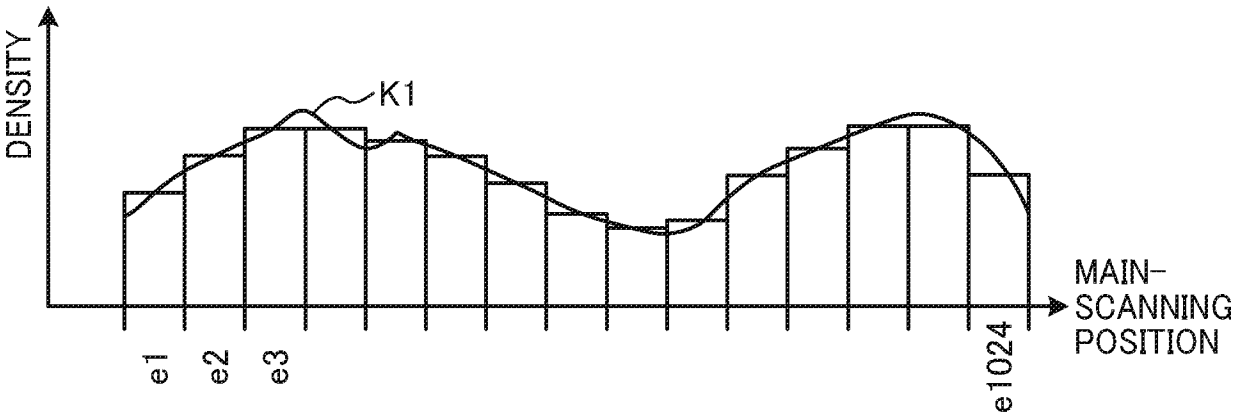
FIG. 6 is a graph illustrating density of sub-areas before correction.

FIG. 6 is a graph illustrating density, before correction, of the plurality of sub-areas e1 to e1024 set.

In FIG. 6, the vertical axis indicates the image density and the horizontal axis indicates the plurality of sub-areas e1 to e1024 aligned in the main scanning direction. A solid line K1 is density data obtained by resolution of the sub-areas e1 to e1024. Each vertical band indicates an average density of each of the sub-areas e1 to e1024. In an initial state without density correction, an output image might include vertical stripes due to density differences. In other words, density unevenness in the main scanning direction causes such vertical stripes to appear on the image. Therefore, correcting the density unevenness or differences overall in the main scanning direction generates an image having an even density, eliminating the vertical stripes. That is, the density of each of the sub-areas e1 to e1024 is corrected to be consistent with an average density of the sub-areas e1 to e1024 in the main scanning direction.

Now, a detailed description is given of the first correction executed by the density correcting unit 13. The density correcting unit 13 obtains, by Equation 1 below, an overall average density "ρ_ave" in the main scanning direction as an average value of respective densities ρ1 to ρ1024 of the sub-areas e1 to e1024.

$$\rho_ave=(\rho 1+\rho 2+\ldots+\rho 1024)/1024 \qquad \text{Equation 1}$$

Based on the overall average density ρ_ave and the respective densities ρ1 to ρ1024 of the sub-areas e1 to e1024, the density correcting unit 13 obtains, as first density correction data, density correction data for each of the sub-areas e1 to e1024. For example, the density correcting unit 13 corrects a light amount of an LED corresponding to a sub-area "n" according to Equation 2 based on the first density correction data thus obtained. In other words, the exposure unit 20 adjusts the light amount of the LED corresponding to the sub-area "n" according to Equation 2, where "ρn" represents a density of the sub-area n. Specifically, the first density correction data is herein a difference between the overall average density ρ_ave and the density ρn of the sub-area n. With the first density correction data, the exposure unit 20 adjusts the light amount of the LED corresponding to the sub-area n. In Equation 2, "PW1(n)_new" represents a light amount of the LED in the sub-area n after the density correction. "PW1(n)_now" represents a light amount of the LED in the sub-area n before the density correction. "α" represents a model-specific parameter.

$$PW1(n)_new=PW1(n)_now\times\alpha\times(\rho n-\rho_ave) \qquad \text{Equation 2}$$

Referring back to FIG. 5, in step S180, the density correcting unit 13 calculates the first density correction data for each of the sub-areas e1 to e1024 as described above.

In step S190, the density correcting unit 13 stores, in the correction value storing unit 21 of the exposure unit 20, the first density correction data thus calculated.

In step S200, the exposure unit 20 adjusts the light amount of each LED according to Equation 2, with the first density correction data thus stored in the correction value storing unit 21.

Figure 7:
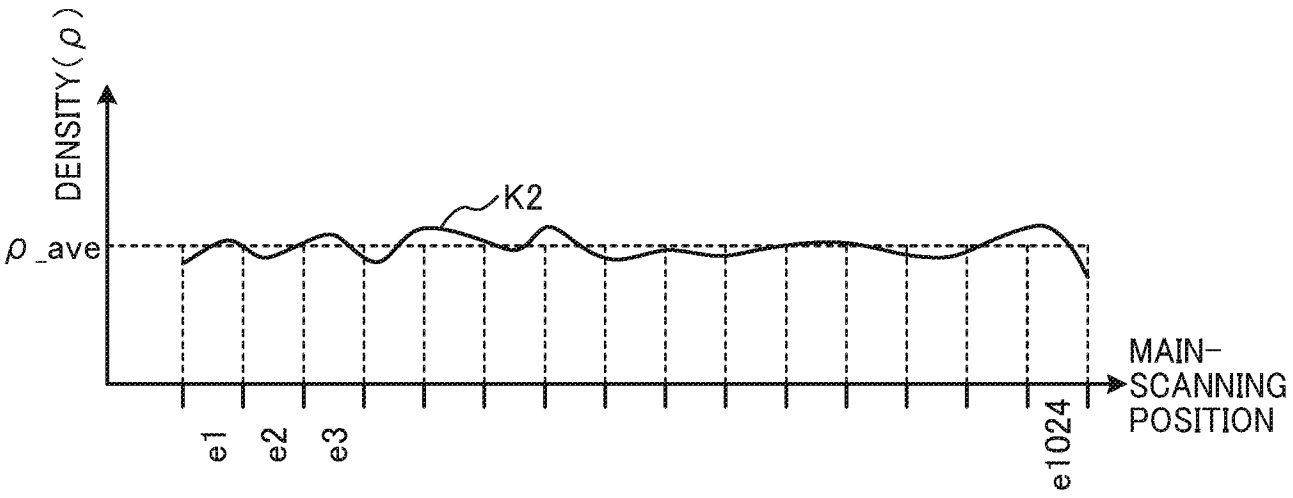
FIG. 7 is a graph illustrating density of the sub-areas after a first correction.

FIG. 7 is a graph illustrating image density K2 of the sub-areas e1 to e1024 after the first correction is executed according to Equation 2 as described above.

Since the respective densities ρ1 to ρ1024 of the sub-areas e1 to e1024 are corrected with the overall average density ρ_ave, the density distribution is even. However, with the first correction alone, an extreme density difference may locally remain on a boundary of sub-areas or within a sub-area.

In such a case, executing the second and subsequent corrections in the same correction way as the first correction and with sub-areas set at the same location as the location set in the first correction may miss correction of a density difference within a sub-area and detection of an error between adjacent sub-areas, even with an increased resolution of the sub-areas. To address such a situation, in the present embodiment, a plurality of sub-areas is set for a subsequent correction such that the plurality of sub-areas has a different location from the location of the plurality of sub-areas set for the first correction. For example, the size of the read areas remains the same while the read start position is shifted backward (i.e., in a direction opposite the main scanning direction) or forward (i.e., in the main scanning direction) by a half of a sub-area in the main scanning direction. Note that the sub-area may be shifted by any value of width in the main scanning direction, except for an integral multiple of the width of the sub-area in the main scanning direction set for the first correction.

The sub-areas are shifted in the main scanning direction from the location of the sub-areas set for the first correction, thus being set for the second correction. Accordingly, an average density of the sub-areas set for the second correction is different from the average density of the sub-areas set for the first correction. That is, errors not appearing in the first averaging process is detectable in the second correction. In particular, the second correction prevents an extreme density difference in a sub-area from failing to be detected. In short, in the second correction, a large density difference is detectable without increasing a read resolution.

Referring back to FIG. 5, in step S100, the test image generating unit 11 outputs a test image again in a state in which the light amount of each LED is adjusted by the first correction described above. Thus, the test image is printed again on the medium 110.

In step S110, the test image thus printed (i.e., printed test image) is set to be read by the reading unit 30.

In step S120, the reading unit 30 determines whether the current correcting operation is the first correction or a subsequent correction (i.e., second or later correction).

When the reading unit 30 determines that the current correcting operation is the second correction (YES in step S120), the reading unit 30 sets read areas, a read start position, and the number of sub-areas for the second correction in steps S210, S220, and S230, respectively. Here, as described above, a plurality of sub-areas has a different location from the location of the plurality of sub-areas set for the first correction. For example, the size of the read areas remains the same while the read start position is shifted in the main scanning direction. The number of sub-areas may be changed from the number of sub-areas set for the first correction.

Figure 8:
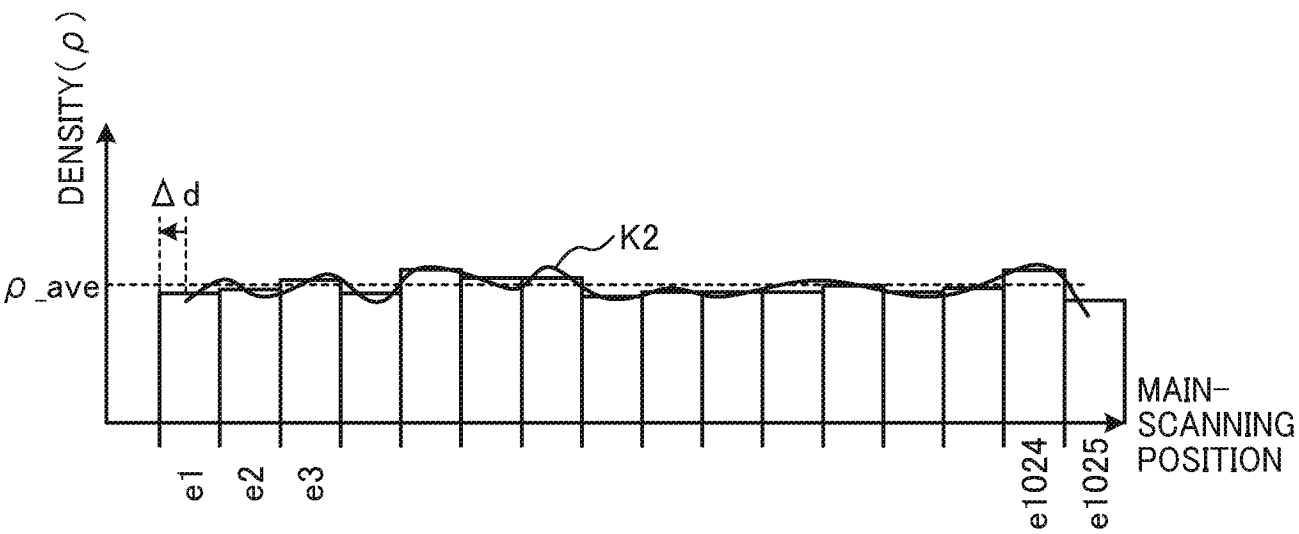
FIG. 8 is a graph illustrating density of sub-areas set for a second correction.

FIG. 8 is a graph illustrating density of a plurality of sub-areas e1 to e1025 set for the second correction.

In FIG. 8, the vertical axis indicates the image density and the horizontal axis indicates the plurality of sub-areas e1 to e1025 aligned in the main scanning direction. The solid line K2 corresponds to the density distribution after the first correction illustrated in FIG. 7. In the example of FIG. 8, the read start position set for the second correction is a position moved backward by a half of a sub-area "Δd" along the main scanning direction from the read start position set for the first correction. The size of the read areas (i.e., sub-areas) is substantially the same as the size of the read areas set for the first correction. In the example of FIG. 8, the number of sub-areas is increased by one to 1025 from the number of sub-areas set for the first correction (i.e., 1024).

Referring back to FIG. 5, In step S240, the reading unit 30 executes reading of the test image based on the read areas, the read start position, and the number of sub-areas thus set.

In step S250, the density data storing unit 12 stores density data of the test image read by the reading unit 30.

The density correcting unit 13 executes the second correction based on the density data stored in the density data storing unit 12. Since a noticeable vertical stripe appears on an image when a density difference between adjacent sub-areas is relatively large, the density correcting unit 13 executes the second correction with density data of adjacent sub-areas to reduce a density difference between the adjacent sub-areas.

Specifically, the density correcting unit 13 executes the second correction based on Equation 3 below, where: "ρn−1" represents density data of an (n−1)th sub-area; "ρn+1" represents density data of an (n+1)th sub-area; and "ρn_ave2" represents a correction target density of an n-th sub-area subjected to the second correction. The density correcting unit 13 calculates the correction target density "ρn_ave2" as an average value of the density data "ρn−1" and "ρn+1". The "ρn_ave2" is herein referred to as second density correction data.

$$\rho n_ave2=(\rho n-1+\rho n+1)/2 \qquad \text{Equation 3}$$

In step S260, the density correcting unit 13 calculates the second density correction data for each of the sub-areas e1 to e1025 as described above.

In step S270, the density correcting unit 13 stores, in the correction value storing unit 21 of the exposure unit 20, the second density correction data thus calculated.

Thus, based on the second density correction data, the density correcting unit 13 corrects the light amount of the LED corresponding to the sub-area n according to Equation 4 below. In other words, with the second density correction data ρn_ave2, the exposure unit 20 adjusts the light amount of the LED corresponding to the sub-area n according to Equation 4 below, where: "PW2(n)_new" represents a light amount of the LED in the sub-area n after the second density correction; "PW(n)_now" represents a light amount of the LED in the sub-area n before the second density correction, that is, a light amount of the LED in the sub-area n after the first density correction; and "β" represents a model-specific parameter.

$$PW2(n)_new=PW(n)_now\times\beta\times\rho n_ave2 \qquad \text{Equation 4}$$

Thus, the second correction enables correction of residual density differences that have failed to be corrected by the first correction. Accordingly, a reliable image is obtained without vertical stripes.

In the example of FIG. 8, the sub-area e1025 is added. Specifically, in the second correction, the sub-area e1025 is added while the other sub-areas e1 to e1024 are shifted from the location of the sub-areas e1 to e1024 set for the first correction. Such setting of the sub-areas enables correction of a portion that has failed to be corrected by the first correction. Note that sub-areas corresponding to opposed ends of the image in the main scanning direction may include white background areas or blank areas. The density of the sub-area including the blank area is set supposing that an image having an overall average density ρ_ave exists in the blank area. For example, second density correction data ρ1025_ave2 of the additional sub-area e1025 is obtained by Equation 5 below, with density data ρ1024 of the sub-area e1024 and the density data ρ_ave of a sub-area e1026 as a blank area. Accordingly, an accurate correction value is obtained with respect to an image end.

$$\rho 1025_ave2=(\rho 1024+\rho_ave)/2 \qquad \text{Equation 5}$$

In the case of executing the third and subsequent corrections, sub-areas are located for the third correction differently from the locations of the sub-areas set for the first and second corrections while a correction process of the third correction is substantially the same as the correction process of the second correction.

In the embodiment described above, the sub-areas are set conforming to a test image area. Alternatively, as illustrated in FIGS. 9 and 10, the sub-areas may be set conforming to the size of the medium 110.

Figure 9:
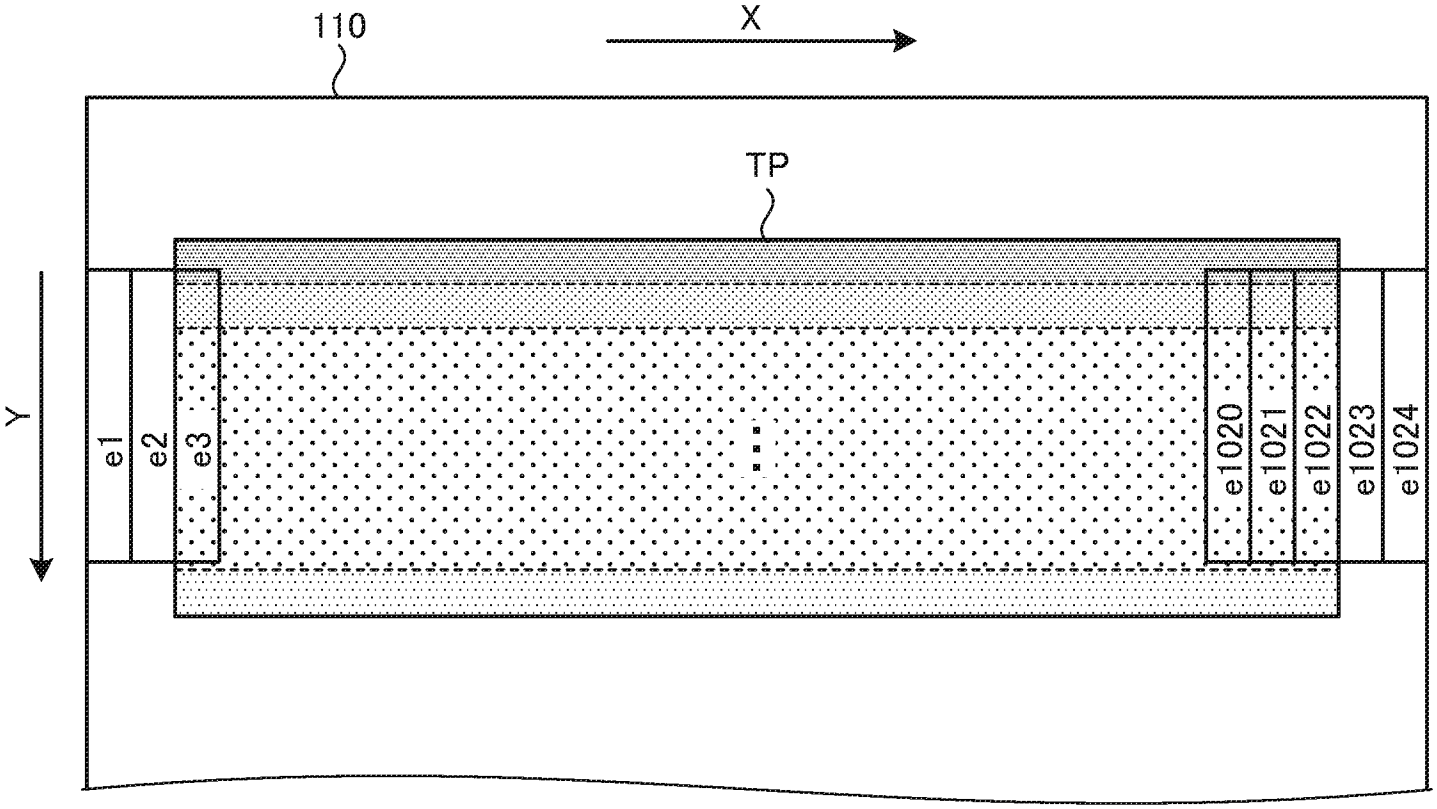
FIG. 9 is a plan view of the test image formed on the medium, illustrating another example of area division for the first correction.
Figure 10:
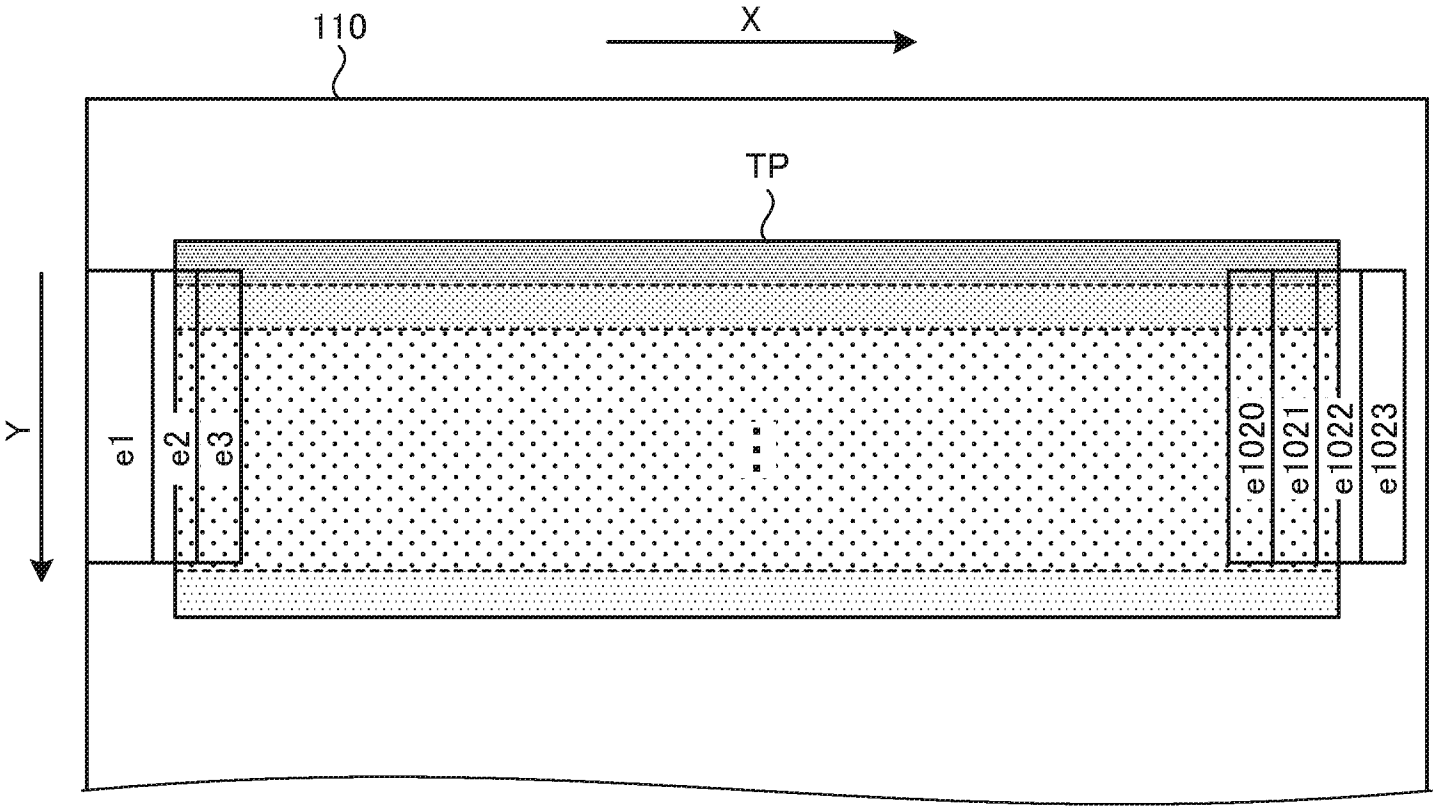
FIG. 10 is a plan view of the test image formed on the medium, illustrating yet another example of area division for the second correction.

FIG. 9 is a plan view of the test image TP formed on the medium 110, illustrating another example of area division for the first correction. FIG. 10 is a plan view of the test image TP formed on the medium 110, illustrating another example of area division for the second correction.

For the first correction, as illustrated in FIG. 9, 1024 sub-areas e1 to e1024 having identical sizes are set from the left end to the right end of the medium 110. For the second correction, the first sub-area e1 is 1.5 times wider, in the main scanning direction, than the sub-area e1 set for the first correction. Each of the second and subsequent sub-areas e2 to e1023 has substantially the same width as the width of the sub-areas e2 to e1023 set for the first correction. Such a change in width causes the location of the plurality of sub-areas set for the first correction to be different from the location of the plurality of sub-areas set for the second correction. Note that the first sub-area e1 for the second correction may have any value of width in the main scanning direction, except for an integral multiple of the width of the sub-area in the main scanning direction set for the first correction.

As described above, according to the embodiment, the plurality of sub-areas set for the second correction has a different location from the location of the plurality of sub-areas set for the first correction. The second correction is performed with the density data of adjacent sub-areas. Accordingly, the second correction reduces density unevenness that has failed to be removed by the first correction. As a consequence, a reliable image is obtained without vertical stripes. In the present embodiment, a reliable image is obtained by a simple process of changing the location of the sub-areas between the first correction and the second correction. In particular, the present embodiment obviates a high detection of density unevenness and acquisition of density data of a read image with a high resolution. Therefore, the present embodiment obviates an increase in capacity of a memory that stores correction data.

According to the embodiments described above, an entire density unevenness and a local density unevenness are corrected.

Although the present disclosure makes reference to specific embodiments, it is to be noted that the present disclosure is not limited to the details of the embodiments described above. Thus, various modifications and enhancements are possible in light of the above teachings, without departing from the scope of the present disclosure. It is therefore to be understood that the present disclosure may be practiced otherwise than as specifically described herein. For example, elements and/or features of different embodiments may be combined with each other and/or substituted for each other within the scope of the present disclosure. The number of constituent elements and their locations, shapes, and so forth are not limited to any of the structure for performing the methodology illustrated in the drawings.

Any one of the above-described operations may be performed in various other ways, for example, in an order different from that described above.

Any of the above-described devices or units can be implemented as a hardware apparatus, such as a special-purpose circuit or device, or as a hardware/software combination, such as a processor executing a software program.

Further, each of the functions of the described embodiments may be implemented by one or more processing circuits or circuitry. Processing circuitry includes a programmed processor, as a processor includes circuitry. A processing circuit also includes devices such as an application-specific integrated circuit (ASIC), digital signal processor (DSP), field programmable gate array (FPGA) and conventional circuit components arranged to perform the recited functions.

Further, as described above, any one of the above-described and other methods of the present disclosure may be embodied in the form of a computer program stored on any kind of storage medium. Examples of storage media include, but are not limited to, floppy disks, hard disks, optical discs, magneto-optical discs, magnetic tapes, nonvolatile memory cards, read only memories (ROMs), etc.

Alternatively, any one of the above-described and other methods of the present disclosure may be implemented by the ASIC, prepared by interconnecting an appropriate network of conventional component circuits or by a combination thereof with one or more conventional general-purpose microprocessors and/or signal processors programmed accordingly.

What is claimed is:

1. An image forming apparatus comprising:

an exposure device including a plurality of lighting elements aligned in a main scanning direction, the exposure device being configured to drive the plurality of lighting elements to form a first test image;

a reader configured to read the first test image; and circuitry configured to:

divide the first test image into a plurality of first sub-areas in the main scanning direction to acquire density data of the plurality of first sub-areas; and calculate first correction data based on density data of each of the plurality of first sub-areas and average density data of the plurality of first sub-areas, to correct a light amount of the plurality of lighting elements based on the first correction data calculated, the first correction data being density correction data for each of the plurality of first sub-areas, the exposure device being configured to form a second test image with the light amount of the plurality of lighting elements corrected, the reader being configured to read the second test image, the circuitry being configured to:

divide the second test image into a plurality of second sub-areas in the main scanning direction to acquire density data of the plurality of second sub-areas, the plurality of second sub-areas having a different location from a location of the plurality of first sub-areas in the main scanning direction; and calculate second correction data based on density data of a second sub-area adjacent to each of the plurality of second sub-areas, to further correct the light amount of the plurality of lighting elements based on the second correction data calculated, the second correction data being density correction data for each of the plurality of second sub-areas.

2. The image forming apparatus according to claim 1, wherein the circuitry is configured to calculate the first correction data based on a difference between the density data of each of the plurality of first sub-areas and the average density data of the plurality of first sub-areas.

3. The image forming apparatus according to claim 1, wherein the circuitry is configured to calculate the second correction data based on average density data of two second sub-areas adjacent to each of the plurality of second sub-areas in the main scanning direction.

4. The image forming apparatus according to claim 1, wherein a number of sub-areas in the plurality of second sub-areas is not less than a number of sub-areas in the plurality of first sub-areas.

5. An image forming method comprising:

driving a plurality of lighting elements aligned in a main scanning direction of an image forming apparatus, to form a first test image and a second test image;

first reading the first test image to divide the first test image into a plurality of first sub-areas in the main scanning direction to acquire density data of the plurality of first sub-areas;

first calculating first correction data based on density data of each of the plurality of first sub-areas and average density data of the plurality of first sub-areas, to correct a light amount of the plurality of lighting elements based on the first correction data calculated, the first correction data being density correction data for each of the plurality of first sub-areas;

second reading the second test image formed with the light amount of the plurality of lighting elements corrected, to divide the second test image into a plurality of second sub-areas in the main scanning direction to acquire density data of the plurality of second sub-areas, the plurality of second sub-areas having a different location from a location of the plurality of first sub-areas in the main scanning direction; and second calculating second correction data based on density data of a second sub-area adjacent to each of the plurality of second sub-areas, to further correct the light amount of the plurality of lighting elements based on the second correction data calculated, the second correction data being density correction data for each of the plurality of second sub-areas.

6. The image forming method according to claim 5, wherein the first calculating calculates the first correction data based on a difference between the density data of each of the plurality of first sub-areas and the average density data of the plurality of first sub-areas.

7. The image forming method according to claim 5, wherein the second calculating calculates the second correction data based on average density data of two second sub-areas adjacent to each of the plurality of second sub-areas in the main scanning direction.

8. The image forming method according to claim 5, wherein a number of sub-areas in the plurality of second sub-areas is not less than a number of sub-areas in the plurality of first sub-areas.

* * * * *